United States Patent [19]

Eckert

[11] 3,931,802

[45] Jan. 13, 1976

[54] FUEL INJECTION SYSTEM FOR INTERNAL COMBUSTION ENGINES

[75] Inventor: Konrad Eckert, Stuttgart, Germany

[73] Assignee: Robert Bosch G.m.b.H., Stuttgart, Germany

[22] Filed: Sept. 12, 1973

[21] Appl. No.: 396,417

[30] Foreign Application Priority Data

Sept. 22, 1972 Germany ..... 2246546

[52] U.S. Cl. ..... 123/139 AW; 123/32 EA; 123/32 AE; 123/139 E

[51] Int. Cl.[2] ..... F02M 39/00

[58] Field of Search ..... 123/139 E, 32 EA, 32 AE, 123/139 AW

[56] References Cited

UNITED STATES PATENTS

| | | | |
|---|---|---|---|
| 3,703,888 | 11/1972 | Eckert | 123/32 AE |
| 3,710,771 | 1/1973 | Cinquegrani | 123/139 E |
| 3,765,387 | 10/1973 | Knapp | 123/32 AE |
| 3,796,200 | 3/1974 | Knapp | 123/32 AE |
| 3,828,749 | 8/1974 | Knapp | 123/139 E |
| 3,842,813 | 10/1974 | Eckert | 123/119 R |

*Primary Examiner*—Charles J. Myhre
*Assistant Examiner*—R. H. Lazarus
*Attorney, Agent, or Firm*—Edwin E. Greigg

[57] ABSTRACT

A fuel injection system for regulating fuel flow so as to maintain a desired fuel-air mixture in a mixture compressing, externally ignited internal combustion engine includes the air intake suction tube of the internal combustion engine. A measuring device is provided for measuring the quantity of air passing through the air intake suction tube. A pressure control device, responsive to output from the measuring device produces, as its output, a variable fluid pressure head. At least one fuel metering valve is responsive to the output from the pressure control device. This fuel metering valve has a movable member, preferably a slide valve piston, which is actuated in two control directions. The fuel metering valve functions to meter out fuel, in desired proportion, into the quantity of air streaming through the suction tube.

22 Claims, 4 Drawing Figures

FUEL INJ ECTION SYSTEM FOR INTERNAL COMBUSTION ENGINES

BACKGROUND OF THE INVENTION

This invention relates, in particular, to a fuel metering and injection system for mixture compressing, externally ignited internal combustion engines. The system includes a fuel line and a metering valve in the fuel line, the valve having a movable valve member which, especially when the movable valve member is embodied as a slide valve piston, meters out to the air quantity streaming through a suction tube a quantity of fuel in a desired proportion. The movable valve member (slide valve piston) can be actuated by a fluid of changeable pressure to influence the metering process. It is the purpose of such fuel metering and injection systems to create automatically a favorable fuel-air mixture for an internal combustion engine, in order to burn the fuel as completely as possible and, therefore, to avoid or to reduce greatly the formation of toxic exhaust gases, while maintaining the highest possible performance or the lowest possible fuel consumption of the internal combustion engine. For this purpose, the desired ratio between air quantity and fuel quantity must be changeable in dependence on engine parameters, such as rpm, load, temperature and exhaust gas composition. Such an adjustment should be possible by the simplest means, i.e., by a simple intercession in the control loop mechanism of the fuel injection system.

In a known fuel injection system of the abovedescribed kind, the slide valve piston is actuated by a mechanical air measuring element via a lever against a nominally constant return force (pressure fluid).

While this known prior art installation has the advantage that, by the use of a liquid pressure medium, it is relatively simple to produce a constant return force, which is easily changeable, there results the disadvantage of a mechanical transmission of the measured air value to the slide valve piston. Because of this fact, supplementary limits are placed on the regulation with respect to intercession in the control loop of the system.

SUMMARY OF THE INVENTION

It is an object of the invention to provide a fuel metering and injection system of the kind described above, taking into account the above-mentioned requirements to be made on such a fuel injection system.

The foregoing object, as well as others which are to be made clear from the text below, is achieved, according to the present invention, by providing a fuel metering and injection system which includes the air intake suction tube of an internal combustion engine of the mixture compressing, externally ignited type. A measuring device is provided for measuring the quantity of air passing through the air intake suction tube. A pressure control device is operatively arranged to respond, at least mediately, to output from the measuring device. The pressure control device generates, as its output, a variable fluid pressure head. At least one fuel metering valve is responsive to output from the pressure control device. The fuel metering valve has a movable member (slide valve piston) which is actuated in two control directions.

The structural components of the fuel injection system, according to the present invention, should, furthermore, be able to serve as modules (building blocks) of fuel injection systems composed of several sub-systems, for example, a combination including an air-quantity meter operating with either electrical means or mechanical means. This task is solved, according to the present invention, in that the movable valve member (slide valve piston) is actuated in both directions by the pressure control means which produces the variable pressure head and is controlled by an element whose set value is determined, at least medially, by an air quantity measurement instrument disposed in the suction tube. That which determines the adjustment of the movable valve member is, in each case, the pressure difference of the fluid on either side of the movable valve member. This pressure difference can occur for short time durations and alternately by intermittent supply of the fluid. It can also be effected solely as a pure fluid pressure control. Thus, according to an advantageous embodiment of the present invention, the control medium can be alternately supplied to move the movable valve member in one or the other control direction, and the pressure and quantity of the control fluid can be adjustable for each control direction in dependence on engine operating parameters.

In the injection system according to the invention, special use is made of the advantage provided by using a fluid as the control medium. This is possible because it is relatively simple to maintain a constant force and subsequently to alter the magnitude of this constant force, depending on the demand, by a change in the fluid pressure level.

According to an advantageous embodiment of the invention, the element for influencing the control medium is a magnetic solenoid valve, which, preferably, is operatively associated with a membrane, as the movable valve member, and which is structurally integrated with the fuel metering and quantity distribution valve.

The movable valve member of the fuel metering and distribution valve is preferably a sliding valve piston which is part of a metering valve structure forming part of the distribution system, in which fuel is delivered by a fuel pump through an annular groove of the slide valve piston to each of several control valves, the flow aperture across section of a control valve being variable by means of a resilient member (membrane) which separates two chambers and where, in the first chamber, the pressure prevailing downstream from the metering valve seat acts on the resilient member in the sense of opening the control valve; whereas, the second chamber contains the pressure prevailing upstream from the metering valve seat, and where the flow aperture cross section of the metering valve is changeable linearly by the axial sliding of the slide valve piston. The axial sliding of the slide valve piston uncovers, depending on its axial position, smaller or larger portions of, in particular, metering slits assigned to each injection valve and disposed in a guide bushing arranged parallel to the axis of the slide valve piston.

According to a supplementary advantageous embodiment of the invention, the air quantity measuring instrument in the suction tube is operatively associated with an electrical circuit which produces an electrical signal, as a result of circuit parameter set, corresponding to the air quantity. This electrical signal is used to determine the control level for the pressure control valve.

An exemplary embodiment of the present invention, as well as several variants thereof, is illustrated, in simplified form, in the accompanying drawing.

DESCRIPTION AND OPERATION OF THE EMBODIMENTS

Figure 1:
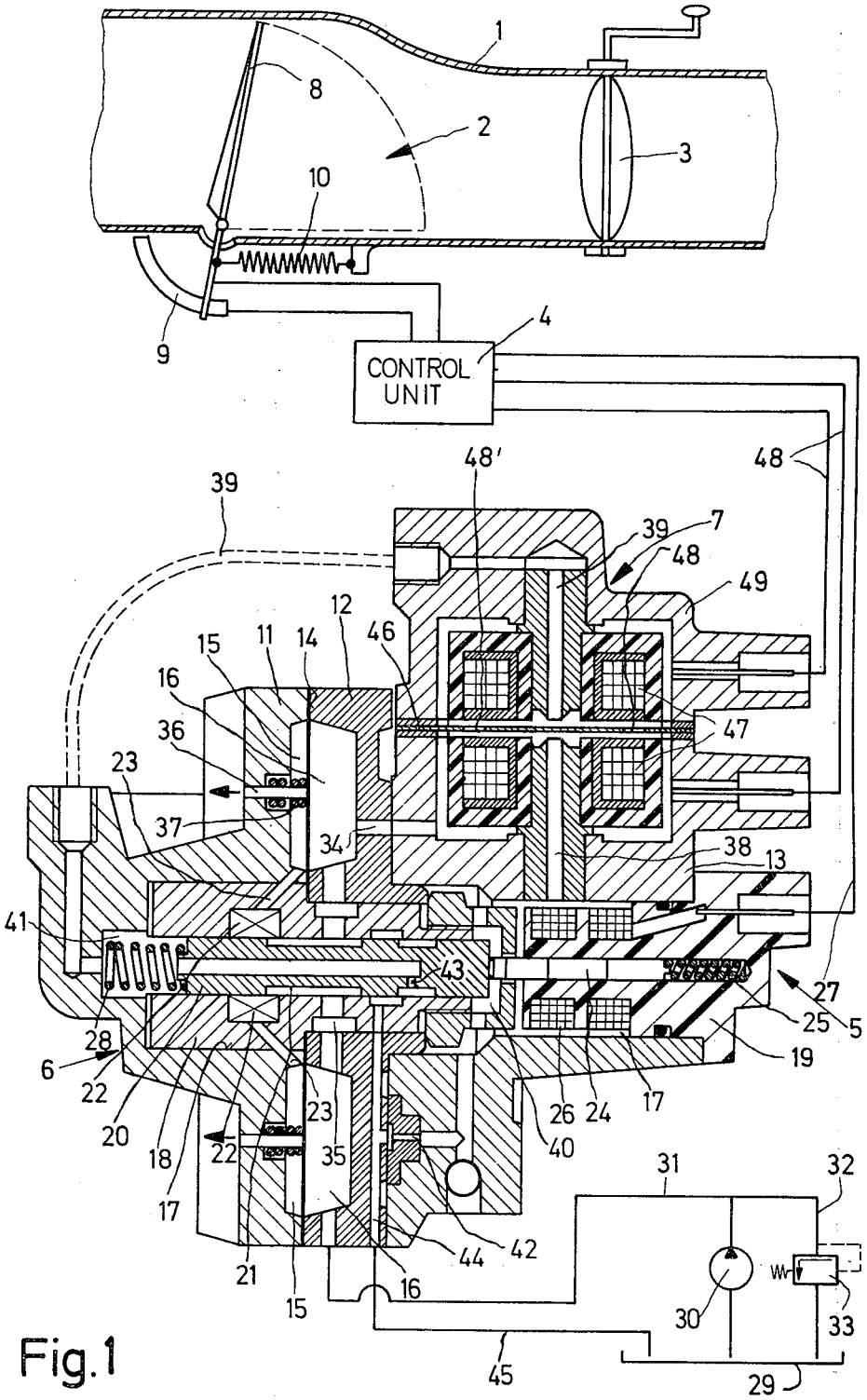
FIG. 1 is a diagrammatic illustration of an exemplary embodiment of a fuel metering and injection system according to the present invention.

Referring to FIG. 1, the illustrated fuel metering and injection system, according to the present invention, includes a conventional air intake suction tube 1. Inside the suction tube 1 there is disposed an air measuring element 2, associated with an electrical circuit, and followed by a throttle flap 3 positioned downstream from the air measuring element 2. The air measuring element 2 produces, in its associated electrical circuit, a variable magnitude electrical output signal which is compared, in an electrical control unit 4, with the magnitude of an electrical output signal from a further electrical circuit operatively associated with a fuel measuring element 5. This further electrical circuit operates in conjuction with a fuel metering and distribution unit, generally designated by the numeral 6. The comparison within the electrical control unit 4 results in the formation of an electrical control signal for a magnetic solenoid valve 7 which, by means of a fuel metering and distribution unit 6, causes a change in the quantity of fuel injected.

The details of the electrical control unit 4 are not necessary for purposes of the present invention, although it may be stated that the circuit disclosed in U.S. Pat. No. 3,796,199 issued to Heinrich Knapp and assigned to the assignee of the present application could be adapted for use as the control unit 4. It would only be necessary to utilize the potentiometer 9 of the air measuring element 2 in place of the temperature sensing means in the intake tube 43, and the fuel measuring element 5 for the temperature sensing means in the chamber 17. The operational amplifier 67 would then compare the signals from the potentiometer 9 and the fuel measuring chamber 5 and adjust the magnetic solenoid valve 7 accordingly.

The air measuring element 2 includes an air flap 8, hinged at one of its edges, which actuates a potentiometer 9 and pivots in opposition to the force of a weak return spring 10.

The fuel measuring element 5, the fuel metering and distribution unit 6 and the magnetic solenoid valve 7 are integrated into a single setting mechanism. The setting mechanism includes three housing members 11, 12 and 13. The housing members 11 and 12 together house the metering and distribution unit 6, and the housing member 13 houses the magnetic solenoid valve 7 and the fuel measuring element 5. A membrane 14 is tensioned between the housing members 11 and 12 and separates two chambers 15 and 16 from one another. Within the distribution unit 6, there are disposed, preferably symmetrically with respect to the contral axis, as many pairs of chambers 15 or 16 as there are injection nozzles in the internal combustion engine (in FIG. 1 only two each such chambers are shown). In a bore 17 traversing the housing members 11, 12 and 13, there are disposed, on the same axis, a bushing 18 and an insert 19 for an inductive position indicator. Within the bushing 18 slides an axially slidable slide valve piston 20 having an annular groove 21 in its circumference. One front edge of the annular groove 21 cooperates with slits 22 disposed within the bushing 18, the slits 22 communicating through bores 23 with the chambers 15. The motions of the slide valve piston 20 are also carried out by an associated slider 24, which serves as the movable part of the inductive position indicator. The slider 24 is pressed against the slide valve piston 20 by a weak spring 25 and cooperates with an inductive coil 26. The inductive coil 26 is connected, through an electrical line 27, to the electrical control unit 4. The slide valve piston 20 is loaded by a spring 28 on the face turned away from the inductive position indicator. This spring 28 pushes the slide valve piston during non-operation of the injection system, into a position in which the communication between the annular groove 21 and the control slits 22 is interrupted (zero supply when the electrical control unit 4 is disabled).

Fuel is pumped from a container 29 by an electric supply pump 30 and is provided through a line 31 to the fuel metering and distribution unit 6. Branching off from the line 31 is a line 32 which leads back to the container 29, a pressure sustaining valve 33 being disposed in line 32. From the line 31, fuel reaches one of the chambers 16 which are connected sequentially in a manner not further shown so that fuel streams from the last chamber 16 in the sequence through a line to the magnetic solenoid valve 7. When the fuel streams through the chambers 16, any air bubbles which may have collected on the membrane 14 are flushed away. From the chambers 16 radiate a plurality of connections 35 which run within the housing member 12 as well as in bushing 18 to the annular groove 21 with which they are in constant communication.

From the mutually separate chambers 15, fuel flows through lines 36 to the fuel injection valves (not shown). The lines 36 extend into the chambers 15 and, together with the membrane 14, they each make up a valve unit to which, additionally, is operatively associated a spring 37 by means of which the valve unit is held normally open and whose action is a parameter which combines with the valve seat cross section and the stiffness of the membrane 14 to control a constant pressure drop. The membrane stiffness and the force of the springs 37 are selected so that during a change of the predetermined pressure-drop existing between associated chambers 15 and 16, the throughput aperture between the membrane 14 and the line 36 is changed for as long as necessary until the predetermined pressure drop has been again attained.

The magnetic solenoid valve 7 controls the motion of the slide valve piston 20 in that the fluid streaming through bore 34 to the magnetic solenoid valve 7 is delivered through the lines 38 and 39 to confined spaces (volumes) 40 and 41 lying, respectively, at the two ends of the slide valve piston 20. If the pressure in space 40 is higher than the pressure in the space 41, then after the force of the spring 28 has been overcome, the slide valve piston 20 is pushed into a position corresponding to a larger injection quantity; if the pressure in the space 40 is less, it is pushed in the opposite direction. The spaces 40 and 41 communicate, through respective throttles 42 and 43, with pressure relief, to a line 44 which is connected to a line 45 and hence to the fuel container 29.

The magnetic solenoid valve 7 shown in FIG. 1 operates with a membrane 46 consisting of magnetizable steel and is actuated by magnets 47. The magnets 47 are connected by lines 48 with the control unit 4. The membrane 46 controls the orifices of the lines 38 and 39, each of which forms, in cooperation with the membrane 46, a valve. When in quiescent condition, the membrane 46 is disposed between the two orifices of the lines 38, 39 in such a way that both valves are open with no current. The membrane 46 includes openings 48' through which fuel streaming from the bore 34 can distribute itself in the two volumes on either side of the membrane 46. The membrane 46 itself is tensioned to the housing member 13 by a housing element 49. Depending on the type of control chosen, determined in the first instance by the type of control unit 4, the fuel distribution to the two faces of the control slide valve piston 20 can be effected by actuating the membrane 46 either intermittently between the valve seats or between one valve seat and the median position, or else by varying excitation of the magnets 47 which move the membrane 46; intermediate positions can be produced in which the orifices of the line 38 and 39 are throttled to a greater or lesser degree and in the opposite sense. Depending on whether the control is intermittent or occurs through a slow displacement, respectively an integral or proportional behavior of the control is achieved.

The operation of the fuel metering and injection system illustrated in FIG. 1 should be clearly evident from the above detailed description. By way of summary, the signal produced by the potentiometer 9 due to the deflection of the air flap 8 is compared with the signal produced by the inductive position indicator of the fuel measuring element 5 due to the axial movement of the slide valve piston 20. The result is a signal to the magnetic solenoid valve 7 and specifically to either of the two magnets 47 on each side of the membrane 46 to thereby attract the membrane 46 toward the valve seat associated with the respective one of the magnets 47 thereby changing the pressure in the lines 38 and 39 and consequently the pressure in spaces 40 and 41. As a result, the slide valve piston 20 is displaced toward the right or left when viewing FIG. 1. For example, the greater the deflection of the air flap 8 the greater should be the displacement of the slide valve piston 20 to the left when viewing FIG. 1 to thereby produce a greater fuel quantity. To achieve this, the upper magnet 47 attracts the membrane 46 toward its associated valve seat in order to increase the pressure in the line 38 and consequently in space 40.

Figure 2:
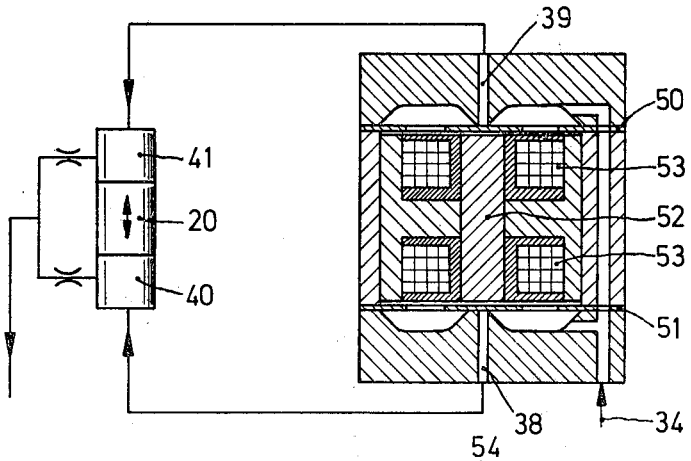
FIGS. 2–4 show variants of the magnetic solenoid valve which may be used in a system constructed according to the present invention.
Figure 3:
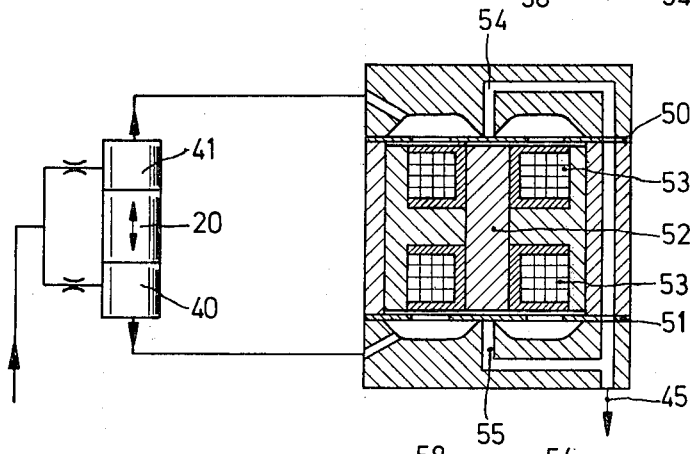
Figure 4:
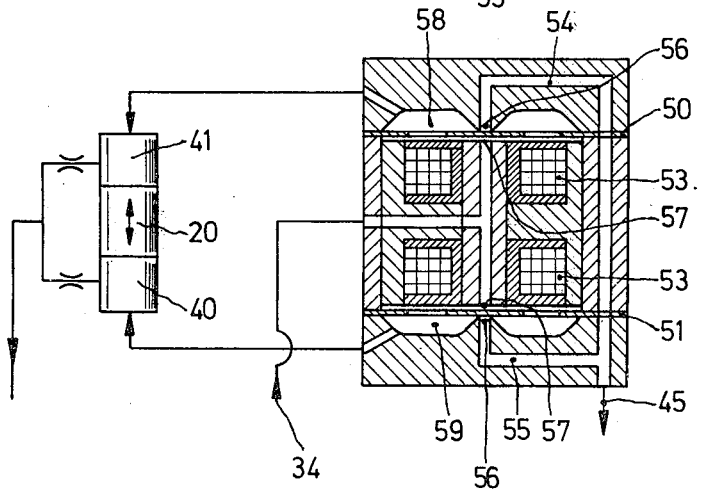

FIGS. 2–4 show different kinds of magnetic solenoid valves of the type that may be used, for example, for the actuation of the slide valve piston 20 which is shown in FIG. 1 in a very simplified form. In each of the three examples, respectively shown in FIGS. 2–4, two membranes 50, 51 are controlled within the respective magnetic solenoid valves which, according to FIGS. 2 and 3, each regulate one valve seat, and in the example of FIG. 4, they each regulate two valve seats.

According to FIG. 2, the membranes 50 and 51 are actuated by a magnetic system having a common core 52 and two exciter coils 53.

FIG. 3 shows a magnetic system as described in FIG. 2 which controls the reflux from the working spaces 40 and 41 on both sides of the slide valve piston 20. The fluid stream direction is exactly opposite from that in the examples of FIGS. 1, 2 and 4. The chambers on both sides of membranes 50 and 51 are separated from one another, whereas channels 54 and 55 controlled by the membrane are connected to one another and terminate in a relief line 45.

In the example according to FIG. 4, the two membranes 50 and 51 each controls two valve seats. Each valve seat 56 is formed by termination of the channels 54 and 55, which are brought together and terminate in the relief line 45. On the opposite side of the membranes lie valve seats 57 through which fuel, brought by the metering and distribution unit through the bore 34, is admitted. The membrane chambers 58 and 59, in turn, are connected to the spaces 40,41 of the slide valve piston 20. In the quiescent position, i.e., when the magnet 53 is switched off, the membranes close off the lines 54 and 55. Depending on the strength of excitation of the magnets 53, the membranes are lifted from the seats 56 and pulled in the direction of the seats 57, by which means the admitted fuel is throttled and the drainage throttling is reduced.

In addition to the shown examples, variety of variations of the control is conceivable, all having the common characteristic that the slide valve piston 20 is hydraulically affected on both sides and is displaced depending on the difference in the fluid pressure, where the control can occur with integral or proportional character.

It is to be appreciated that the above-described and illustrated exemplary embodiments of fuel metering and injection systems constructed in accordance with the present invention have been provided as non-limiting examples. Numerous changes may be made in the illustrated embodiments and other embodiments constructed without departing from the spirit and scope of the invention, as defined in the appended claims.

That which is claimed is:

1. A fuel metering and injection system for regulating fuel flow so as to maintain a desired fuel-air mixture in a mixture compressing, externally ignited internal combustion engine, the system comprising, in combination;

a. an air intake suction tube of the internal combustion engine;

b. electro-mechanical means for measuring the quantity of air passing through said air intake suction tube;

c. pressure control means, responsive at least mediately to output from said electro-mechanical means for measuring, for generating as its output a variable fluid pressure head;

d. at least one fuel metering valve responsive to output from said pressure control means and having a movable member for metering out fuel, in desired proportion, to the quantity of air streaming through said suction tube in desired proportion, said movable member being actuated in two control directions.

2. A system according to claim 1, including means for delivering the control fluid alternately to said movable member to effect movement in either of said control directions.

3. A system according to claim 1, including means responsive to at least one engine operating parameter for changing the pressure head and quantity of the control fluid for each of said control directions.

4. A system according to claim 1, wherein said control means include a magnetic solenoid valve means for influencing the control fluid, said magnetic solenoid valve means including a further movable member comprising a membrane.

5. A system according to claim 4, wherein said magnetic solenoid valve means includes first and second throughput apertures for passing the control fluid, said first throughput aperture is increased for one control direction said second throughput aperture for the opposing control direction is correspondingly diminished.

6. A system according to claim 4, wherein said magnetic solenoid valve means includes a magnet excitable intermittently, whereby at least one fluid stream may be intermittently interrupted to effect movement in one of the two control directions.

7. A system according to claim 4, further comprising a spring, and wherein said magnetic solenoid valve means includes a magnet having a linear characteristic curve, said membrane being actuated, against force of said spring, by said magnet.

8. A system according to claim 4, including two valve seats, and wherein said membrane is disposed between said two valve seats as a movable valve member cooperating therewith.

9. A system according to claim 8, including at least two of said further movable members, each being provided with two valve seats which guide selectively a delivered control fluid stream in either one control direction or into a low pressure chamber.

10. A system according to claim 8, wherein said magnetic solenoid valve means includes a magnet disposed on each side of said membrane for actuation thereof.

11. A system according to claim 4, including a plurality of independently controllable valves for influencing fluid streams for each of said two control directions.

12. A system according to claim 10, including a magnetic block, and wherein said further movable member is constituted by a pair of membranes which are disposed on two sides of said magnetic block, these membranes controlling said valve seats on that side of the respective membranes turned away from said magnetic block.

13. A system according to claim 4, wherein said fuel metering valve and said magnetic solenoid valve means are contained within one structural unit.

14. A system according to claim 1, further comprising a guide bushing, a supply pump, a plurality of control valves having throughput apertures and two chambers separated by a resilient member, and wherein said movable member is provided with an annular groove and is a slide valve piston which is part of a metering valve and distribution unit in which fuel from said supply pump is passed through said annular groove and is further delivered to each control valve of said plurality of control valves whose said throughput aperture is changeable by said resilient member separating said two chambers, the first chamber of said two chambers being provided with pressure prevailing downstream of said movable valve member, which pressure acts on the resilient member in the sense of opening said member, whereas the second chamber of said two chambers is provided with pressure prevailing upstream of said movable valve member, the throughput aperture of said metering valve being linearly changeable by axial displacement of said slide valve piston in that the slide valve piston uncovers, depending on its axial position, smaller or larger portions of metering slits assigned to each injection valve and disposed in said guide bushing, said bushing being positioned parallel to the axis of said slide valve piston.

15. A system according to claim 14, wherein at least part of fuel, delivered by said pump, continuously and sequentially streams through one of said chambers forming part of each control valve, these chambers being secondary chambers.

16. A system according to claim 1, wherein the control fluid is fuel which is derived from the actual fuel line.

17. A system according to claim 1, wherein said electro-mechanical means for measuring the quantity of air in said suction tube operates an electrical circuit which produces an electrical signal, the magnitude of which corresponds to air quantity, this signal determining control level of said pressure control means.

18. A system according to claim 17, including a signal comparator, and additional electrical circuit means for metering fuel quantity to develop a further electrical signal, this further electrical signal and the electrical signal produces by said circuit associated with said electro-mechanical means for measuring the quantity of air being compared in said signal comparator to produce a control signal from the comparison difference, said pressure control means being responsive to the control signal.

19. A system according to claim 18, including inductive means for measuring the position of said movable member of said fuel metering valve.

20. A system according to claim 1, further including a spring, and wherein said movable valve member is additionally loaded by said spring with a weak force which displaces said movable valve member during non-operation into a terminal position for zero fuel injection quantity.

21. A system according to claim 15, including throttles, a magnetic solenoid valve, a pair of working chambers, and a low pressure space, and wherein fuel, after streaming through said secondary chambers, is delivered to said magnetic solenoid valve and drains from said working chambers for the purpose of displacing said movable member and drainage occurs through said throttles into said low pressure space.

22. A system according to claim 15, including throttles, magnetic solenoid valve, two working chambers and a low pressure space, and wherein fuel streams through said secondary chambers and afterward is delivered through said throttles to said two working chambers which communicate, through one line each, with said magnetic solenoid valve means which controls drainage of fuel into said low pressure space.

* * * * *